US005404607A

United States Patent [19]

Sebor

[11] Patent Number: 5,404,607

[45] Date of Patent: Apr. 11, 1995

[54] SELF-PROPELLED SUBMERSIBLE SUCTION CLEANER

[76] Inventor: Pavel Sebor, 45 Highcliff Way, Extension 12, Johannesburg, Transvall, South Africa

[21] Appl. No.: 978,237

[22] Filed: Nov. 18, 1992

Related U.S. Application Data

[63] Continuation-in-part of Ser. No. 880,662, May 11, 1990, Ser. No. 880,663, May 11, 1992, Ser. No. 880,664, May 11, 1992, Ser. No. 880,665, May 11, 1992, Ser. No. 880,666, May 11, 19902, Ser. No. 880,667, May 11, 1992, Ser. No. 880,668, May 11, 1992, and Ser. No. 880,669, May 11, 1992.

[51] Int. Cl.[6] ..... E04H 3/20

[52] U.S. Cl. ..... 15/1.7; 92/125; 251/175

[58] Field of Search ..... 15/1.7, 420, 421, 404, 15/416; 92/125; 251/176, 175; 137/110, 112, 527.8, 527.6, 527; 210/169

[56] References Cited

U.S. PATENT DOCUMENTS

| | | | |
|---|---|---|---|
| 3,005,224 | 10/1961 | Magarian | 15/421 |
| 3,023,741 | 3/1962 | O'Connor | 92/125 |
| 4,023,227 | 5/1977 | Chauvier | 15/1.7 |
| 4,133,068 | 1/1979 | Hofmann | 15/1.7 |
| 4,208,752 | 6/1980 | Hofmann | 15/1.7 |
| 4,275,474 | 6/1981 | Woodard | 15/1.7 |
| 4,498,206 | 2/1985 | Braukmann | 15/1.7 |
| 4,521,933 | 6/1985 | Raubenheimer | 15/1.7 |
| 4,536,908 | 8/1985 | Raubenheimer | 15/1.7 |
| 4,807,318 | 2/1989 | Kallenbach | 15/1.7 |
| 4,849,024 | 7/1989 | Supra | 15/1.7 |
| 4,939,806 | 7/1990 | Supra | 15/1.7 |

FOREIGN PATENT DOCUMENTS

| | | |
|---|---|---|
| 476413 | 3/1992 | European Pat. Off. . |
| 2520422 | 1/1982 | France . |

*Primary Examiner*—David A. Scherbel
*Assistant Examiner*—Gary K. Graham
*Attorney, Agent, or Firm*—Allen, Dryer, Doppelt, Franjola & Milbrath

[57] ABSTRACT

A self-propelled submersible suction cleaner as used to clean the surfaces of a swimming pool transfers a vibratory movement of an oscillator located within the flow path of a suction chamber for propulsion over the submerged surface of the pool. This vibratory movement of the oscillator is also converted to a unidirectional rotational motion used in conjunction with a gear train to cause the cleaner to rotate through at least a 90 angle allowing the cleaner to improve on the random path taken by the cleaner and to maneuver away from obstacles such as pool steps potentially stopping the cleaner movement. The cleaner includes a elevation limiter that keeps the suction chamber submerged as the cleaner climbs a vertical wall and attempts to rise above the water level in the pool. A pressure relief valve eliminates the concern over debris blocking the suction and causing potential damage to the pool pump and motor. Additional features including a shoe dimensioned to improve the forward movement resulting from the vibratory motion, shoe skirts in combination with a shoe flap to control suction, and bellows configurations to aid in better execution of sharp turns up a vertical wall as well as a smoother movement of the cleaner are disclosed.

21 Claims, 9 Drawing Sheets

SELF-PROPELLED SUBMERSIBLE SUCTION CLEANER

CROSS REFERENCE TO RELATED APPLICATIONS

The present application is a continuation-in-part of the following prior United States applications:

| SER. NO. | APPLICATION TITLE |
|---|---|
| 07/880,662 | Ground Engaging Means for a Submersible Cleaning Device |
| 07/880,663 | Friction Clutch Drive for a Submersible Cleaning Device |
| 07/880,664 | Rigid Skirt for Bristles of a Submersible Cleaning Device |
| 07/880,665 | Sliding Oscillator Seal for a Submersible Cleaning Device |
| 07/880,666 | Elevation Limiter for a Submersible Cleaning Device |
| 07/880,667 | Internal By-Pass Valve for a Submersible Cleaning Device |
| 07/880,668 | Mechanism for Dislodging a Submersible Cleaning Device from the Surface |
| 07/880,669 | Positive Engagement Clutch for a Submersible Cleaning Device |

This application is related to the above referenced applications having a United States filing date of May 11, 1992 and a foreign priority date of Feb. 2, 1992. This application and the above copending applications are commonly assigned.

FIELD OF THE INVENTION

The invention generally relates to suction cleaners for use on surfaces submerged in a liquid. The suction cleaner is attached to a flexible hose and pump for its source of suction. The invention relates to a device for automatically cleaning the submerged surfaces of swimming pools and the like.

DESCRIPTION OF BACKGROUND ART

Self-propelled suction cleaners are customarily used for cleaning the submerged surfaces of pools and in particular, swimming pools having various surface finishes and contoured shapes. Various techniques have been employed in the mechanisms that drive these self-propelled cleaners. Three of the more common mechanisms use either a shut off valve, turbine drive or drive wheels. In some cases, combinations of these mechanisms are used.

The U.S. Pat. No. 4,536,908 issued to Johann N. Raubenheimer on Aug. 27, 1985 discloses a suction cleaner for a swimming pool that is supported on a bogie or truck assembly with inclined supporting feet. The bogie assembly is mechanically rocked by means of a turbine through which water is pulled by suction to cause the cleaner to move. In order to change the direction of path of the cleaner, a second turbine drives a hose connection at the top of the cleaner in opposite directions with long periods of dwell in between. In other words, the device is continuously driven in the forward or turning directions.

A turbine driven swimming pool cleaner is also disclosed in the U.S. Pat. No. 4,939,806 issued to Carl F. Supra on Jul. 10, 1990. In this Supra device, a cleaner having a head is mounted on wheels. There is a suction passage and a propeller which is driven by the turbine and which propels the head. A rudder, which is oscillated via a gear train driven by the turbine, is used to vary the direction of movement of the head.

A turbine and wheel styled device is disclosed in the U.S. Pat. No. 5,099,535 issued on Mar. 31, 1992 to Daniel J. V. D. Chauvier, Cleaner for Submerged Surfaces. In this Chauvier device, a cleaner for a submerged surface comprises a body that defines a suction passage and pressure passage. The suction passage extends between an inlet and outlet in the body and is connectable to the inlet of a filtration system by flexible hose. A second hose connects the inlet on the device to an outlet of the system. Water flowing under pressure to the inlet drives a turbine which in turn drives hind wheels to displace the apparatus over the surface while debris or the like is sucked up through the suction passage and out through the hose that is attached to the filtration system. The suction and return hoses are those of the flexible kind typically used in swimming pool cleaning systems.

In the U.S. Pat. No. 4,208,752 issued to Helmut J. Hofmann on Jun. 24, 1980, an apparatus for cleaning swimming pools in a stepwise movement over the pool walls comprises a balanced operating head having an inlet and an outlet, the outlet adapted to be swivelably connected to a longitudinally resilient and flexible suction hose. The inlet axis is inclined at an angle to that of the outlet. A passage extends through the head from inlet to outlet, and an oscillator valve in the head is adapted to alternately open and close said passage. A baffle plate is disposed in the head between the inlet and valve to form a restricted suction connection between inlet and outlet around the valve when the passage is closed. The flow of water causes the valve to oscillate between its two terminal positions. In one position, the flow is full and direct through the opening and passage to the outlet. In the other position of the valve, there is a maximum reduction in liquid flow through the head. This results in an intermittent cut off flow through the head as the valve oscillates between its terminal positions, and this in turn causes pulsation which result in longitudinal contractions and relaxations in the longitudinally resilient suction pipe from the head to the outlet from the swimming pool to its filter unit. In consequence of these contractions and relaxations and a simultaneous reduction and increase of the force applied to hold the cleaning head disc against the surface to be cleaned, a step by step movement of the head takes place over the surface to be cleaned.

The U.S. Pat. No. 4,807,318 issued to Dieter H. F. Kallenbach on Feb. 28, 1989, Suction Operated Cleaner, an automatic pool cleaner is disclosed which also operates on the interruption of an induced flow of water through the cleaner. The interruption in the flow of water drawn through the pool cleaner is used to provide a propulsive force to cause the cleaner to move over submerged pool surfaces. The control of the interruption is effected through a tubular axially resilient diaphragm one end of which is closed and adapted to hold normally closed a passage from the head of the pool cleaner to the usual form of flexible hose connecting the pool cleaner to the filtration unit. The flow of water through the pool cleaner causes a suction in a passageway greater than that in a connection, the result being that a spring and diaphragm force the closure of the passageway. The intermittent interruption of flow through the passageway and hose, and the simultaneous release of the force holding the cleaner and disc against the submerged surface causes the cleaner to move in a stepwise manner over the surface to be cleaned.

In addition to the mechanism used to move the cleaning device along the submerged surface to be cleaned, various appendages have been added to these devices to provide some control over the cleaning pattern and for control of the cleaner when encountering obstacles such as abrupt surface changes and exiting the submersible fluid in which they were designed to operate. The art of submersible pool cleaners has been open to these various methods of automatically propelling the cleaner over the surfaces to be cleaned because any one brings inherent problems with its design.

In cleaning devices using shut off valves, the valve intake tends to clog with larger debris and in order to correct this condition, the cleaning device must be removed from the pool and disassembled for cleaning. The membranes used in these units have a tendency to break and require replacement. The dramatic reduction of flow needed to create the step by step movement of the cleaning device results in severe changes in the pressure head at the suction pump thus placing additional wear on this pump and motor. Cleaning devices using turbine styled systems must depend on the high speed movement of the turbine, large number of bearings and the needed multitude of parts to convert the high speed to the relatively slow cleaning movement. In addition, the many bearing surfaces perform poorly after performance in the sand which grinds down the bearing parts. The cleaning devices relying on wheels for their traction encounter problems when climbing the vertical walls of typical swimming pools. The wheels slip in attempting to maneuver on the vertical wall and will slip under certain conditions when climbing from the deep end to the shallow end of the pool.

Many of the devices used tend to follow an established pattern once placed into operation. This pattern, often a figure eight style, tends therefore to avoid certain areas over others that see the cleaner more often than necessary. Finally, the onset of new plastics and fiberglass surfaces for swimming pools has created the added demand on these devices to be able to maneuver over slippery surfaces not before encountered. The goal in the art is to find that device which will cover the desired submerged surfaces, be able to execute vertical walls, escape obstacles, avoid climbing out of the submersible fluid where the sucking in of air will cause damage and interrupt operation, place a minimum of excess demand on the system suction pump and motor, and have as few failing parts as possible.

SUMMARY OF INVENTION

The present invention contemplates a self-propelled suction cleaner used in conjunction with a pool suction pump and motor for removing dirt and debris from the submerged surfaces of the pool. It is also contemplated that the system and method are useful in other environments. The cleaner is connected at a coupling located on top of a housing. The coupling is connected to the suction pump and motor using a flexible elongated hose. The cleaner housing incorporates a suction chamber located within the housing. The suction chamber comprises an entrance end in proximity to the submerged surface to be cleaned and an exit end communicating with the coupling.

An oscillator is pivotably mounted within the suction chamber. As the water flows past the oscillator, a to and fro motion results. The shape and size of the chamber between the oscillator and the coupling cause abrupt changes in water flow and a continuous vibratory movement of the housing. The housing has peripheral walls. A shoe is formed around the periphery of the housing and adapted to engage the submerged surface to be cleaned. The shoe comprises tread elements which are angled in a forward direction with respect to the surface. The element angles and the vibratory motion of the housing cause the cleaner to advance in a random pattern over the submerged surfaces including a vertical surface of the pool. In preferred embodiments the elements of the shoe which engage the surface take on elongated tracks parallel to each other and perpendicular to the forward movement or can be a plurality of finger elements with each element angled. In the preferred embodiment, the angles range from a more perpendicular angle in front of the housing shoe than in the back with each track or element changing angle progressively away from perpendicular as the elements go from front to back.

By making the coupling rotatable, the cleaner can be made to turn at established intervals throughout the random path and allow the cleaner to free itself from pool obstructions. Means is provided for converting a reciprocal angular movement or to and fro movement of the oscillator to an angular movement in one direction for purposes of driving a shaft by incorporating a ratchet and pawl assembly. A drive gear essentially affixed to the shaft engages a gear train. The gear train engages the rotatable coupling at defined intervals to generate rotation of the coupling at these defined intervals.

Means for limiting the elevation of the cleaner as it climbs a vertical wall of the pool comprises a limiter member affixed to and extending forward and out from the housing. The member is dimensioned and disposed such that when the upper end of the member breaks the surface of the water, gravitational force diminishes any forward impetus of the housing and the extended member acting as a moment arm has the effect of turning the cleaner back toward the water. By affixing a hollow limiter member to the housing and having openings in the hollow member communicating with openings in the housing so as to permit the water to fill the hollow member, the relative weight of the cleaner while submerged in the water is reduced making the to and fro motion of the cleaner more effective in propelling the cleaner forward. Yet the increased weight of the limiter member as it rises out of the water due to the water contained within the limiter member turns the cleaner back toward the water.

Debris can clog the suction chamber at the chamber entrance end proximate to the surface being cleaned. To prevent debris from reducing flow to a point that creates excess suction damaging to the pump and motor, the suction chamber comprises a pressure relief valve. The pressure relief valve comprises a by-pass opening in a housing wall communicating with the suction chamber. A by-pass closure is fitted over the by-pass opening and moveable between a closed position in which the water is prevented from flowing through the opening and an open position in which the water flows from the by-pass opening and into the coupling on to the pump. The by-pass closure is held closed using a spring biasing means in the preferred embodiment. The opening in the housing wall is a plurality of slots in the preferred embodiment.

A gap is located between oscillator side walls and the suction chamber walls. This gap should be as small as possible for optimum flow through the chamber and resulting optimum oscillator forces. As the gap size increases, flow through the gap inhibits oscillator vibration. Grit and debris can fill the gap and impair oscillator movement. The preferred embodiment comprises an oscillator having an elongated groove along the edge of the oscillator and a sealing strip extending into the groove and extensible across the gap.

The present art includes a variety of suction cleaners. A sample of the more typical suction cleaners using vibrator valves, turbine assemblies, and wheels were described in the background section of this specification. There are inherent problems in each of these suction cleaners. Debris clogs cleaners using vibrator valves and membranes to a point where the membrane breaks and needs replacement or as a minimum the cleaner requires disassembly before clearing and reassembly. Turbine mechanisms have a high speed movement. The high speed movement demands bearing surfaces and complex speed reducing parts. The sand and grit found in a typical swimming pool quickly wears the bearing surfaces and the sand generally grinds down these parts. Wheeled cleaners have problems climbing walls. The wheels slip when encountering the vertical walls and the steep inclines running from the deep end of typical pools to the shallow end. The present cleaning devices tend to slip on the contemporary surfaces made from fiberglass and vinyl. Most of the cleaning devices require smooth transition areas and can get hung up on a step as an example. Many cleaners form a pattern within the pool which is not efficient for cleaning all surfaces. The shut off valve styled cleaners use a stepping motion to propel the cleaner forward that intermittently and dramatically cuts the flow and induces high suction and pressure causing excess strain for the pump and motor.

It is the object of the disclosed invention to avoid the problems inherent in the designs described and provide a self-propelled suction cleaner using continuous suction flow through the cleaner and this continuous flow to provide the vibrating motion needed to advance the cleaner forward. The invention provides means for limiting the elevation of the cleaner above the water line of the pool and thus prevent the pump from sucking unwanted air. The random pattern of the cleaner as it advances over the pool surface is enhanced by a turning means that prevents the cleaner from becoming hung up at obstacles such as pool steps and abrupt surface changes. Should debris clog the cleaner suction chamber, a pressure relief valve will be activated and will eliminate excess strain on the pump and motor.

During operation of the preferred embodiment, nominal pressures ranging between 10 kPa were measured at a position proximate to the weir in a pool cleaning system. Open hose pressures were measured at approximately 8 kPa. In contrast, devices relying on flow cut off to initiate movement generate nominal pressures ranging from 22 kPa to 30 kPa when measured at the same weir position. (1 kPa equals 1000 Pascal units, a metric measure of pressure. One pound per square inch is equivalent to 6.89 kPa units.)

BRIEF DESCRIPTION OF DRAWINGS

A preferred embodiment of the invention including alternate elements is described by way of example with reference to the accompanying drawings in which.

DETAILED DESCRIPTION OF PREFERRED EMBODIMENT

Figure 1:
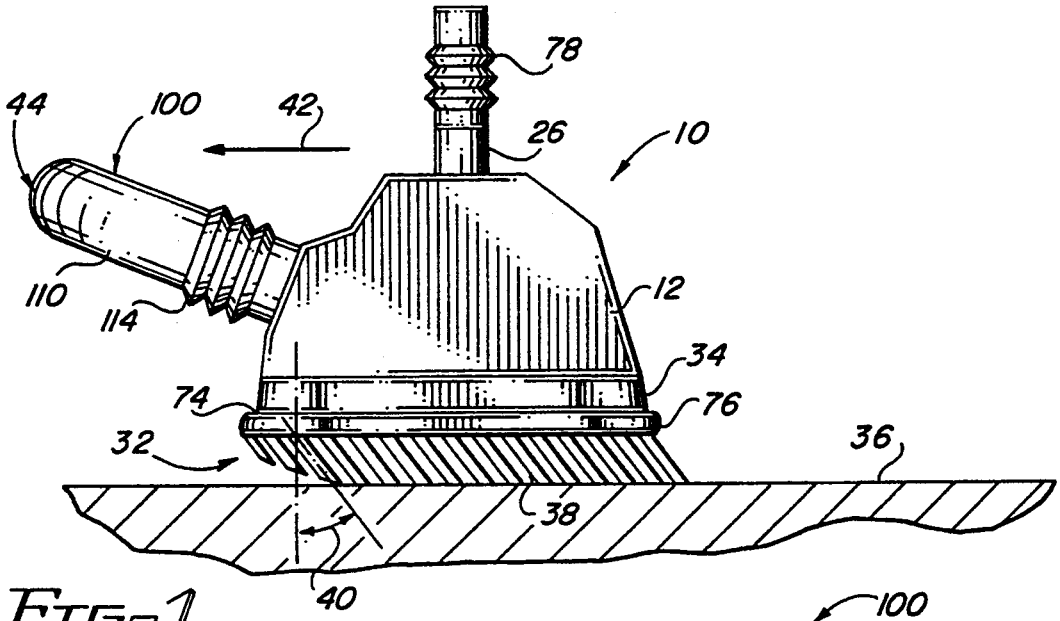
FIG. 1 is a side view of the preferred embodiment for the self-propelled submersible cleaner.

The preferred embodiment of the invention, a self-propelled submersible suction cleaner 10 particularly describes a swimming pool cleaner 10 which makes use of the flow of water through a cleaner housing 12. This embodiment is generally described in FIG. 1 through FIG. 4 of the enclosed drawings. The housing 12 contains a suction chamber 14 having a mouth 16 located at an entrance end 18 in which water flows. The chamber exit end 24 communicates with a coupling 26 located on top of the housing 12. In the preferred embodiment, the coupling is rotatable. The propulsion mechanism for the cleaner 10 includes an oscillator 20 pivotally mounted to side walls 22 of the chamber 14. The oscillator 20 is disposed within the flow path of the water through the suction chamber 14. The flow is caused by connecting the suction chamber 14 to a filter pump and motor by a suitable flexible hose as is typically done in the pool cleaning art. The hose is connected at the coupling 26. The oscillator 20 is so shaped that flow therepast causes it to move to and fro about its pivot point and impact the forward 28 and aft 30 walls of the chamber 14 to create a vibratory movement of the chamber 14 and housing 12 to which the chamber 14 is an integral part. This vibratory movement acting on the housing 12 causes a shoe 32 attached at the periphery 34 of the housing 12 and in contact with the pool submerged surface 36 to vibrate. The shoe 32 has tread elements 38 contacting the submerged surface 36 at an angle 40. This angle 41 is such to drive the housing 12 in a forward direction and thus propel the cleaner 10 over the submerged surface 36 of the pool.

The cleaner 10 being propelled in this forward direction 42 (illustrated in FIG. 1) would typically take a somewhat random path determined by the pool surface contours peculiar to any given swimming pool. To improve on the randomness of the path and avoid developing a path pattern, the preferred embodiment of this invention incorporates a turning mechanism 200 using a rotatable coupling 26 and means for converting the vibratory motion to a rotating motion for turning the cleaner 10 at intervals through at least a 90° turn. Such a turn during the random path will insure that the path does not establish a pattern, typically a figure eight in many swimming pools. In addition, should the cleaner 10 encounter an obstacle such as a step, typically found in swimming pools, the 90° or greater turn will permit the cleaner to maneuver away from the step.

The cleaner 10 will climb the submerged vertical wall of the swimming pool and reach the surface of the water. Noting FIG. 1 and FIG. 9, the preferred embodiment includes an elevation limiter 100 which stops the forward progress of the cleaner and in combination with the turning mechanism 200 turns the cleaner back toward the water as it climbs up the submerged vertical wall and beyond the surface of the water. This limiter 100 allows the suction chamber 14 to always see a flow of water and avoids the detrimental sucking of air by the pump.

The suction chamber 14 is configured to accept the sand and even larger debris such as leaves typically found in swimming pools and not clog. However, should the suction chamber clog up and severely increase pressure in the chamber 14 and to the pump, a pressure relief valve 300 is a part of the preferred embodiment. The following further describes the invention with additional detailed descriptions of the elements making up the preferred embodiment of the cleaner 10 and alternative embodiments for some of these elements.

The Oscillator 20 and suction chamber 14 can be further described as follows:

In order for the oscillator 20 to operate efficiently it must be located in a suction chamber 14 so that the oscillator 20 pivots in close proximity to side walls 22 of the chamber 14. This is necessary so that the bulk of flow past the oscillator 20 moves along surfaces such as edges 46 designed to provide the to and fro movement of the oscillator.

Figure 2:
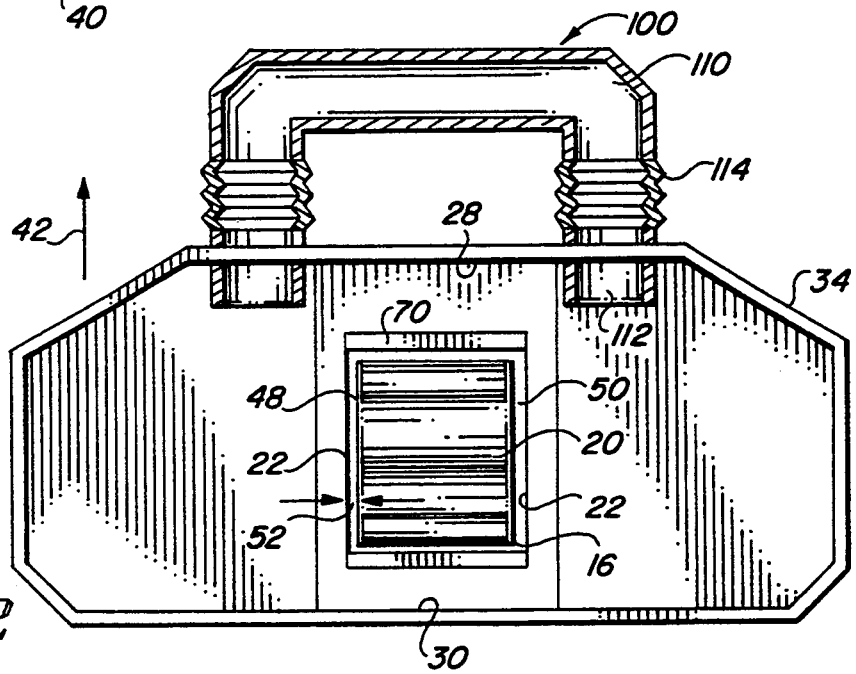
FIG. 2 is a bottom view of the cleaner housing shown with shoe removed.
Figure 3:
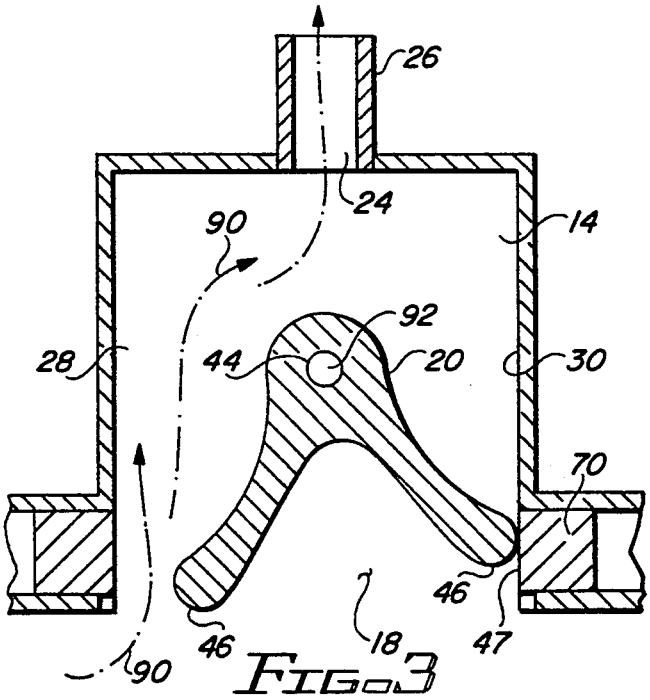
FIG. 3 is a partial cross-sectional side view of the suction chamber illustrating the arrangement of the oscillator and buffer formations.

The suction chamber located within the housing 12 is comprised of side walls 22, forward wall 28 and aft wall 30, the forward and aft walls defined by the housing 12 in the preferred embodiment as illustrated in FIG. 2 and FIG. 3.

The oscillator 20 (shown in FIG. 3 and FIG. 5) is pivotally mounted within the suction chamber 14 on a hinge pin 92 extending through a hole 44 in the oscillator, the hinge pin 92 being journalled on the side walls 22.

As illustrated in FIG. 3, the liquid flow 90 into the suction chamber 14 via the mouth 16 of the housing 12 impinges on the oscillator 20 flowing around the edges 46 causing the oscillator 20 to swing to and fro on its hinge pin 92 impacting against the chamber forward 28 and aft 30 walls. Buffer formations 70 are placed between the edges 46 of the oscillator 20 and chamber walls 28 and 30. In addition the flow has an abrupt change at the top of the chamber as the flow 90 moves past the oscillator 20 toward the chamber exit and coupling 26.

It will be appreciated that the efficiency of the operation of the oscillator 20 depends on the strength of flow over the oscillator edges 46. If this flow is dissipated around the side edges 48 and 50 of the oscillator between the latter and the chamber side walls 22, the strength of the flow past the oscillator edge 46 will be diminished with a consequent drop in the efficiency of the propelling action of the oscillator.

In order to prevent such dissipation of the flow energy, the arrangement may be one in which the oscillator 20 is neatly located between the chamber side walls 22 so that little flow is dissipated. In this event, however, grit drawn into the suction chamber 14 is liable to lodge between the oscillator 20 and side walls 22 thereby causing loss of efficiency of the oscillator 20 through friction, or the oscillator 20 may even stick.

Figure 6:
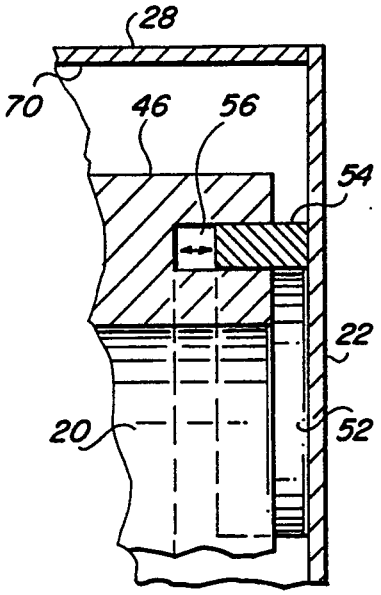
FIG. 6 is a partial cut-away view of a section of the oscillator showing the seal arrangement.

In accordance with the present invention the oscillator 20 (shown in FIG. 5) and suction chamber 14 are designed so that the edges 48 and 50 are suitably spaced from the side walls 22 of the suction chamber 14 to enable grit to pass easily therethrough. Retractable elongated seals 54 are provided at each edge of the oscillator 20 to seal the gap between the edges 48 and 50 of the oscillator 20 and the side walls 22 of the suction chamber (shown in FIG. 6).

Elongated seals 54 (FIGS. 5 and 6) are located in slot 56 in the respective edges 48 and 50 of the oscillator 20, the width of the seals 54 being no greater than the depth of the slots 56.

Figure 5A:
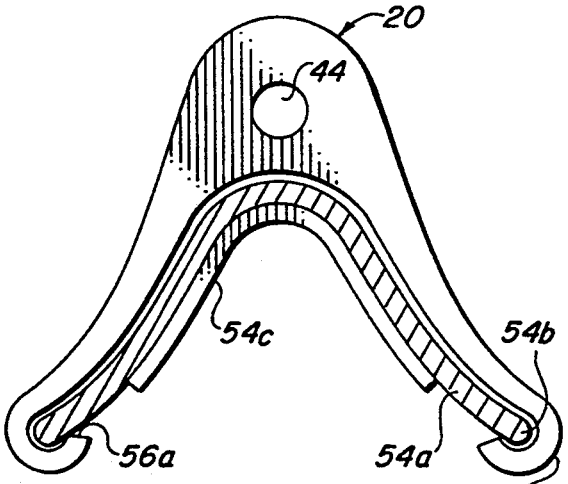
FIG. 5*a* (side view) and FIG. 5*b* (bottom view) show alternate embodiments for the oscillator and seal arrangement.
Figure 5B:
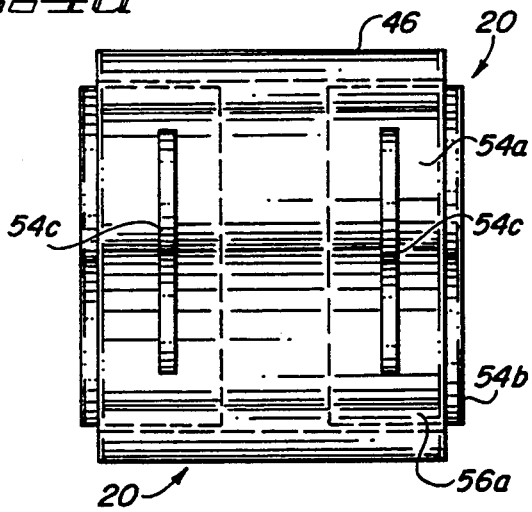
FIG. 5 is a perspective view of an oscillator used in the preferred embodiment.
Figure 5:
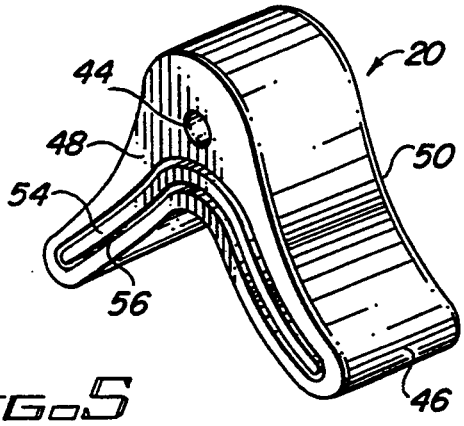

In an alternate embodiment (illustrated in FIGS. **5*a* and 5*b*) for the oscillator 20, seals 54*a* are contoured to the oscillator 20 and have their ends 54*b* riding in slots 56*a* located at the oscillator edges 46 (as shown in FIGS. 5*a* and 5*b*). Slide bars 54*c* are affixed to the seals 54*a* to provide a means for sliding the seals 54*a* back and forth so as to dislodge grit during a cleaning process for the cleaner 10. Thus when the suction chamber 14 is coupled to a filter pump and water is caused to flow around the oscillator 20 in the suction chamber 14, the seals 54 are drawn outwardly from the slots 56 into sealing engagement with the chamber side walls 22 of the suction chamber 24. Under normal operation of the oscillator 20 the engagement between the elongated seals 54 and the chamber side walls 22 causes minimal friction and little impairment of the efficiency of the oscillator 20. In the event that grit finds its way between a seal 54 and the side walls 22, the seal 54 is simply forced to retract into the slots 56 allowing the grit easily to pass through the suction chamber 24** and into the filter system of the swimming pool.

Figure 7:
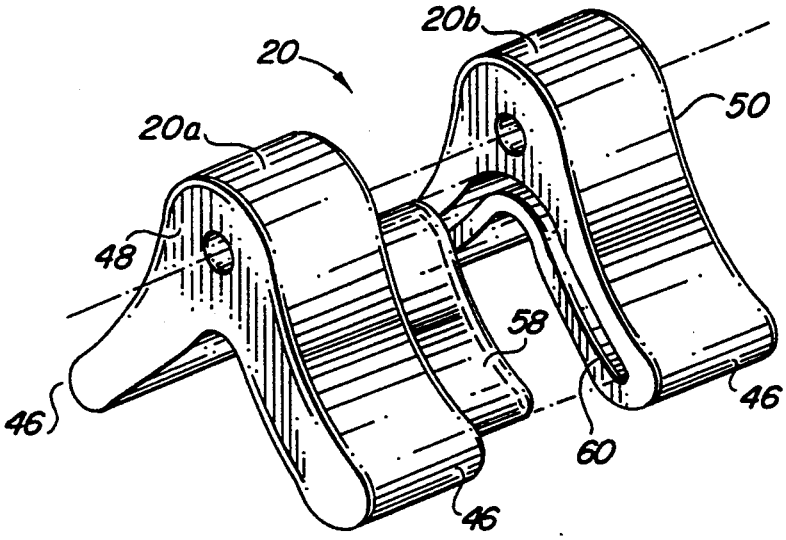
FIG. 7 shows an alternate embodiment of a split oscillator in perspective view.

Referring now to FIG. 7, it will be seen that in an alternative arrangement the oscillator 20 is split into two sections 20*a* and 20*h*. The oscillator sections 20*a* and 20*b* have a groove 60. A tongue 58 is slidable into and out of the groove 60.

In the event that grit finds its way between the seal sides 48 and 50 and the chamber side walls 22, the oscillator sections 20*a* and 20*b* are simply forced to retract along the tongue 58 and into the groove 60 of oscillator sections 20*a* and 20*b* thereby opening a gap between oscillator sections 20*a* and 20*b* and side chamber walls 22 of the suction chamber 14 and thus allowing the grit easily to pass through the suction chamber 14 into the pool system filter. As shown in FIG. 5*a*, the slot 56 is suitably oversize with respect to the seal 54 to prevent dirt or grit from lodging between them.

Figure 8:
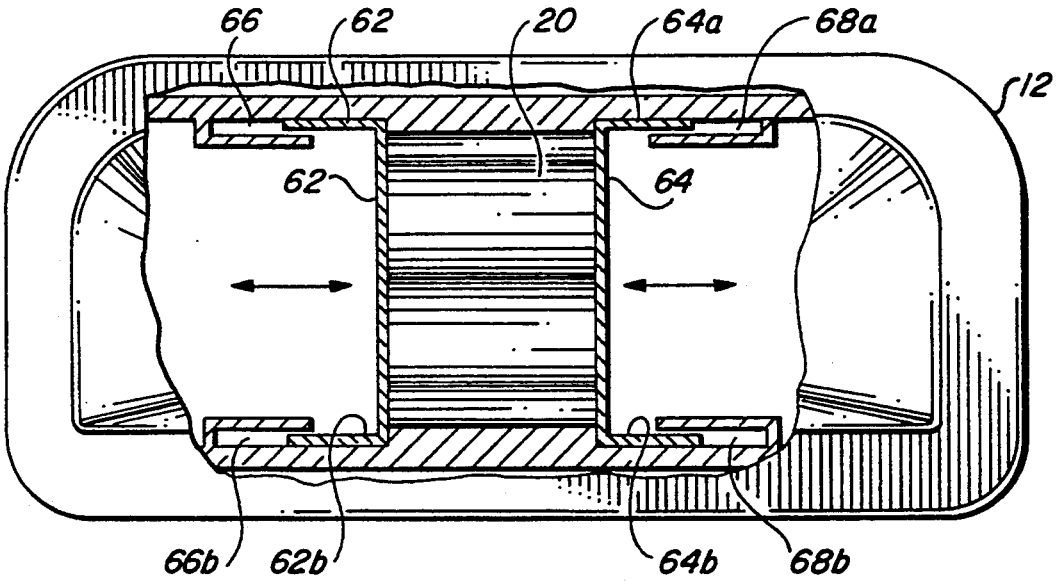
FIG. 8 is a bottom view of another embodiment using moveable suction chamber side walls.

Referring now to FIG. 8, a second alternative is provided in the form of a suction chamber 14 having side walls 62 and 64 mounted so as to allow end sections 62*a* and 62*b* and 64*a* and 64*b* to be slidable into and out of guide tracks 66*a*, 66*b* and 68*a*, 68*b*, respectively.

Under normal conditions the side walls 62 and 64 are drawn against the oscillator 20 by the suction created within the suction chamber 14. However, should grit enter between the oscillator 20 and the walls 62 and 64 the latter simply retract into the guide tracks 66*a*, 66*b* and 68*a*, 68*b* allowing the grit to pass through the suction chamber into the pool filter system.

Because of the strength and frequency of the impact on the forward 28 and aft 30 chamber walls by the oscillator, buffer formations 70 as illustrated in FIGS. 2 and 3 are affixed to the chamber walls 28 and 30 at an impact location 47 between the impacting oscillator edge 46 and chamber wall. In the preferred embodiment these buffer formations 70 are rubber-like pads. These buffer formations thus protect the housing 12 and in general the cleaner 10 from damage resulting from the action of the oscillator.

Figure 4:
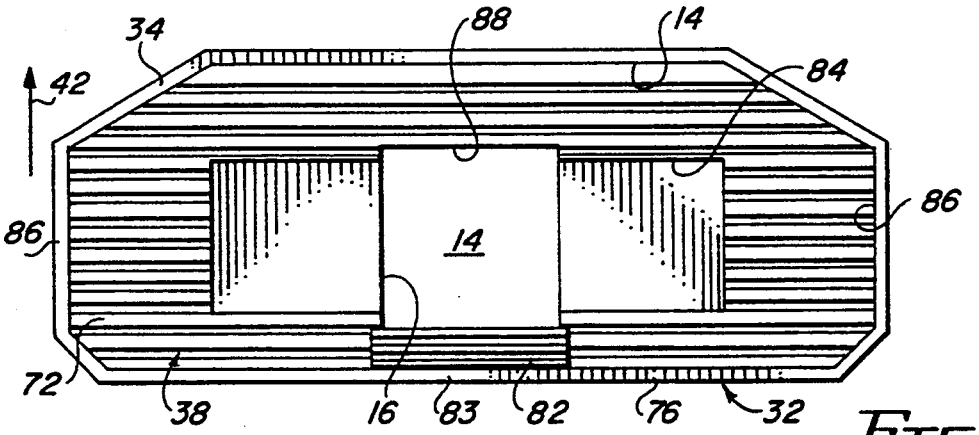
FIG. 4 is a bottom view of a shoe having elongated track elements, the skirt elements are displayed.

The shoe 32 can be further described as follows:

As disclosed earlier and in FIGS. 1 and 4, the shoe 32 comprises a plurality of tread elements 38. The tread elements 38 can be in the form of elongated tracks 72 as shown in the preferred embodiment of FIG. 4 having the track elements 72 spaced and generally parallel to each other with the elongated element perpendicular to the forward direction 42 of the cleaner movement. The elements 72 are angled forward with respect to the submerged surface. In the preferred embodiment shown in FIG. 1, the elements 72 form an acute angle 40 with respect to a perpendicular to the shoe. As the elements progress from the front of the housing 74 to the rear 76, the angle 40 increases progressively for each respective element 72. The first few rows of elements 72 at the front 74 are shorter than in the middle or rear in order to better execute the climbing of a steep vertical pool wall.

In addition to this climbing feature in the preferred embodiment, a coupling bellows 78 is fitted to the coupling 26. This bellows 78 provides added flexibility to the end of the flexible hose and permits improved execution of the steep vertical pool wall. FIG. 1 discloses this coupling bellows 78 configuration.

Figure 10:
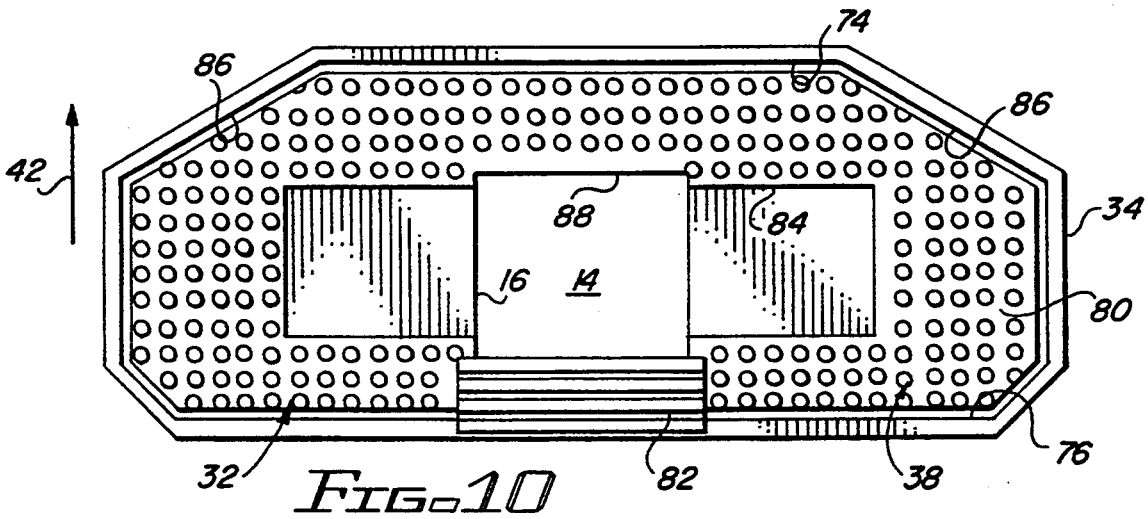
FIG. 10 is a bottom view of a shoe tread incorporating finger elements, skirt elements are shown.

In an alternate arrangement, the shoe 32 is configured with tread elements 38 that are made from a plurality of finger elements 80 set in a matrix array as described in FIG. 10. The matrix is made from parallel rows of finger elements 80 spaced in a similar manner as the parallel rows of track elements 72. Each row of finger elements 80 is angled and configured as the track elements 72 with a tread element angle 40 and progression of increasing angles when moving from front to back as described earlier.

Figure 4A:
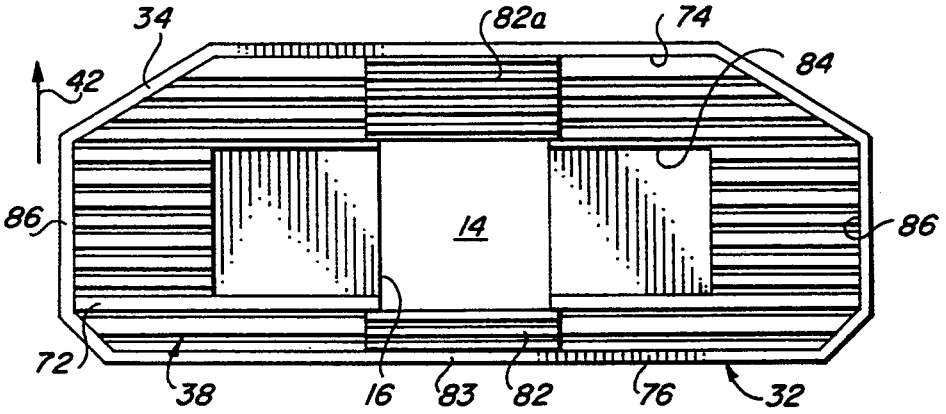

The outside portion of the shoe 32 making contact with the surface has an outside dimension defined by the housing periphery 34 and an inside dimension to provide sufficient contact with the surface to be cleaned and an opening to allow access to the mouth 16. The tread elements 38, whether finger elements 80 or track elements 72, define a shoe removably affixed to the housing periphery passing partially around the mouth 16 of the suction chamber 14. A flap 82 (illustrated in FIG. 4 and FIG. 9) is pivotally affixed to the housing periphery directly behind the suction chamber aft wall 30 along a flap edge 83 as illustrated in FIG. 4. In an alternate embodiment, the flap 82 is made an integral part of the shoe which shoe then passes completely around the mouth 16. The flap 82 is a means for flow adjustment and control by pivoting open and closed during variations in suction. In yet another embodiment, the flap 82 on the trailing edge and a second flap 82*a* on the leading edge are made an integral part of the shoe and removably affixed to the suction chamber as illustrated in FIG. 4*a*. In addition to the flap 82, an internal skirt 84 (refer to FIG. 4 and FIG. 10) and external skirt 86 are positioned near the periphery and prevent the free flow of water through the shoe elements thus causing the suction to increase. The skirts can be made a part of the shoe elements or a part of the housing. In the preferred embodiment, both methods are incorporated. An internal skirt portion 88 is comprised of an extension of the forward chamber wall. The balance of the internal skirt 84 is a part of the shoe as is the external skirt 86. The height of both skirts is slightly shorter than the tread elements 38 to permit the elements 38 to flex during their vibratory and propelling movement.

Figure 9:
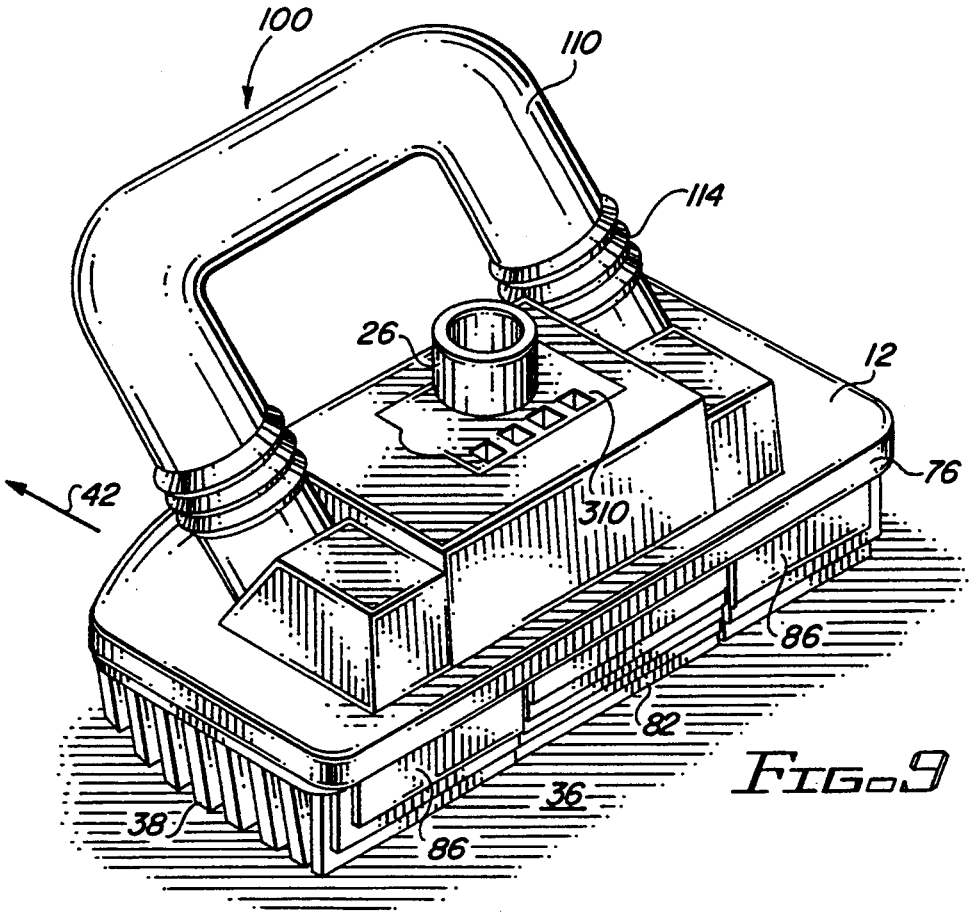
FIG. 9 is a perspective view of the cleaner from the rear showing the rear skirt and pressure relief valve apertures.

The skirts project downwardly as described. In a preferred embodiment the external skirt 86 is configured such that the tread elements 38 are almost fully exposed at the front of the housing 12 but project only slightly beyond skirt at the rear of the housing as illustrated in FIG. 9.

The internal skirt portion 84 can be molded integrally with the housing 12 and be located adjacent the elements and internally thereof and extends from one side of the suction chamber 14 the other along the front thereof. Both the external skirt 86 and internal skirt 84 are also laterally spaced from elements so that the elements are able to flex under the vibratory action of the oscillator It will be appreciated that the flow of water into the suction chamber 14 is directed around the free edges of the internal 84 and external skirts 86 in order to provide sufficient suction through the suction chamber 14 on a submerged surface engaged by the cleaner 10.

As an additional note, it is a feature of the invention that the leading edge of the oblong shape of the shoe is a straight edge disposed substantially at right angles to the direction of movement of the cleaner 10. Preferably the rear edge will likewise is a straight edge as shown in FIG. 2. It has been found that the straight, front and rear edges of the shoe 32 and tread elements 38 enhance the mobility and climbing ability of the cleaner. As shown in FIG. 4*a*, the shoe 32 may also include a rear flap 82*a* which extends from the rear and inwardly toward the chamber, and is elongated in a direction parallel with the direction of housing elongation.

As discussed, it has been found that the differential angle of the elements (illustrated in FIG. 1) in the leading and trailing edges, enhances the climbing ability of a cleaning device through an upwardly radiased curved surface, the climbing ability of the suction cleaning is further enhanced by the straight leading and trailing edges of the skirt formation.

The elevation limiter 100 can further be described as follows:

The housing 12 includes a limiter member 110 which for the preferred embodiment comprises an inverted U-shaped pipe connected at its ends to the housing 12 towards the sides thereof so that the open ends 112 of the pipe communicate with the housing 12.

As illustrated in FIG. 1 and FIG. 2, the member 110 extends upwardly and forwardly with respect to the housing 12 and when the latter is immersed in a pool the member 110 fills with water.

With forward motions of the cleaner 10 up the side wall of a pool, the cleaner rises until the upper end of the member 110 breaks the surface of the water whilst the suction chamber 14 of the housing 12 is still located just below the surface. As the member 110 emerges from the surface of the water it undergoes an apparent gain in weight and the upward and forward extent of the member 110 and its dimensions are designed so that the gain in weight balances the forward impetus of the head when the latter is just beneath the surface. In this way the member 110 operates as an elevation-limiting device preventing the suction chamber 14 from breaking the surface of the water and drawing in air which would impair the operation of the pump.

By adding a flexible portion to the extension member 110 proximate to the housing 12, the vibratory motion of the housing 12 causes the extended limiter member 110 to flex. This flexing reduces the resistance created by the movement of the member 110 through the water, thereby allowing freer vibration and thus efficient operation of the cleaner 10. In the preferred embodiment, bellows couplings 114 are affixed to the limiter member 110. The flexible nature of the bellows 114 provides a sufficiently reduced moment arm and provides the smoother forward movement for the cleaner 10.

The turning mechanism 200 can further be described as follows:

In order to more clearly illustrate the invention, an embodiment for a drive mechanism is described hereunder with reference to the accompanying drawings of FIGS. 14 through 18.

A drive mechanism 210 illustrated in FIG. 14 through FIG. 17) is used with the submersible cleaner 10 for translating reciprocating angular movement 212 of a drive shaft 214 into one directional angular movement 216 of a driven gear 218. The driven gear 218 can perform a number of functions for the pool cleaner and it is in particular envisaged that it will drive a gear train 220 mechanism for a pool cleaner through a number of reduction gears 222, such as that shown in FIG. 18 and used to turn a rotatable coupling gear 254 and thus the coupling 26.

The drive mechanism comprises a peripheral ring 221 of teeth 228 secured or integrally formed within a drum 230 defined at the end of the driven gear 218. The teeth are periodically engaged by a plurality of pawl or sprag elements 232 which are pivotally mounted in pockets 234 defined in a collar formation 231 at the end of the drive shaft 214. The collar 231 of the drive shaft 214 and the sprag elements 232 are thus disposed within the drum 230 of the driven gear 218 to enable the sprag elements 232 periodically to engage the internal teeth 228.

The pockets 234 which pivotally mount the sprag elements 232 define opposed abutment surfaces 234*a*, 234*b*, which act to limit pivotal movement of the sprag elements 232 between a first extreme position (shown in FIG. 15) wherein the sprag elements 232 are substantially radially disposed to engage the teeth 228; and a second extreme position (shown in FIG. 16) wherein the sprag elements 232 are angled relative to the radial and out of engagement with the teeth 228.

It is a feature of the invention that the sprag elements 232 operate in a liquid medium, such as water, preferably the same liquid in which the surface to be cleaned is immersed, and this medium tends to impart a high degree of inertia to the sprag elements 232. The free ends 232*a* of the sprag elements 232 thus tend to remain stationary during angular movement of the drive shaft 214 in one direction or the other. Thus, with the sprag elements 232 in the first extreme position and radially orientated (FIG. 15), rotational movement of the drive shaft 214, for example, in an anti-clockwise direction causes the sprag elements 232 to move to the second extreme position (FIG. 16) and remain in such position during further anti-clockwise rotation of the drive shaft 214. Likewise, when the shaft 214 reverses its direction of rotation to a clockwise direction, the sprag elements 232 will immediately straighten out to the first extreme position wherein they are radially oriented and engage the teeth 228 of the driven gear 218.

In order to permit rotational movement of the driven gear 218 to one directional movement, the invention further provides a pawl 240 and ratchet 242 arrangement comprising peripheral ratchet teeth 242 defined on the outer periphery of the drum 230 which are engaged by means of the pawl 240 which is mounted independently of the drum 230.

The driven gear 218 will rotate during the movement of the cleaner 10 through the described translation of reciprocating angular movement 212 into one direction angular movement or rotation. This rotating driven gear 218 can be coupled with a variety of drive mechanisms including a mechanism to lift the suction chamber to break suction, and drop the cleaner off a vertical wall as an alternative embodiment for the elevation limiter 200 discussed earlier.

In the preferred embodiment, the driven gear 218 is used in conjunction with a gear train 220 (described in FIGS. 18 through 22) that engages a coupling gear 254 engaged with the coupling 26. The driven gear 218 engages a first gear 244 and a series of reduction gears 222 to engage an interval drive gear 248. The interval drive gear 248 contains a set of interval teeth 250 that engage the coupling gear 254 through a translational intermediate gear 252. Sufficient teeth 250 are placed on the interval drive gear 248 to allow the coupling 26 to rotate through at least a 90° turn.

In an alternate embodiment of the drive mechanism (FIG. 23 through FIG. 25), a friction drive is adapted to translate oscillating angular movement of a drive shaft 214 into periodic one directional angular movement of a driven gear 218. The driven gear 218 can then drive further gears as earlier described to cause the rotation of the cleaner 10.

Figure 25:
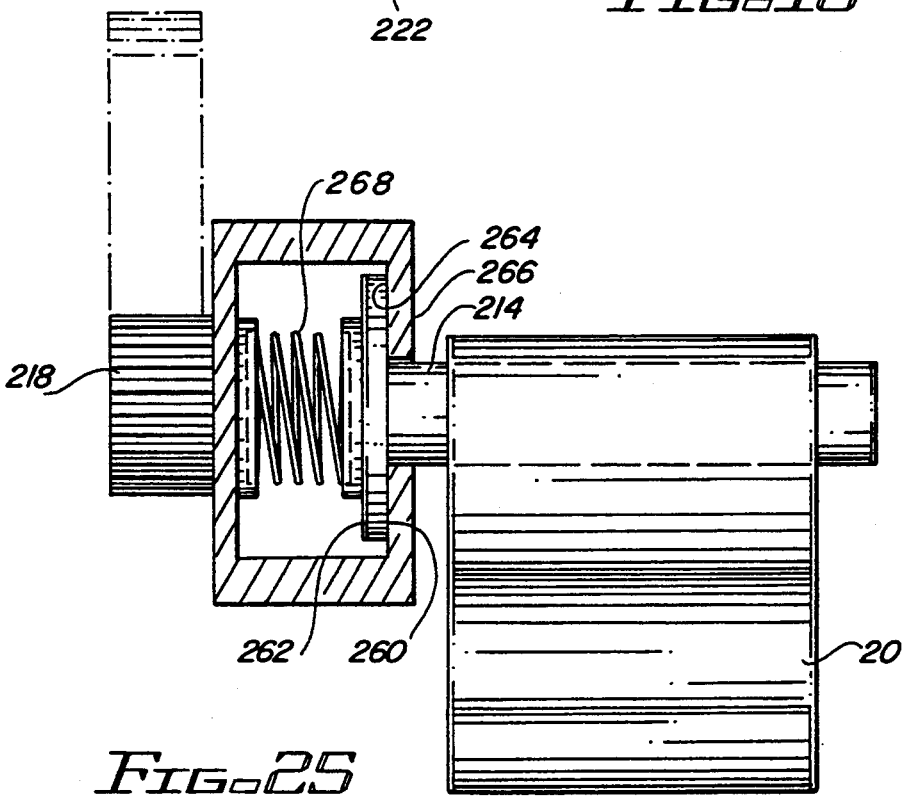
FIG. 25 is a partial cross-sectional view of the friction drive mechanism communicating with the oscillator.
Figure 20:
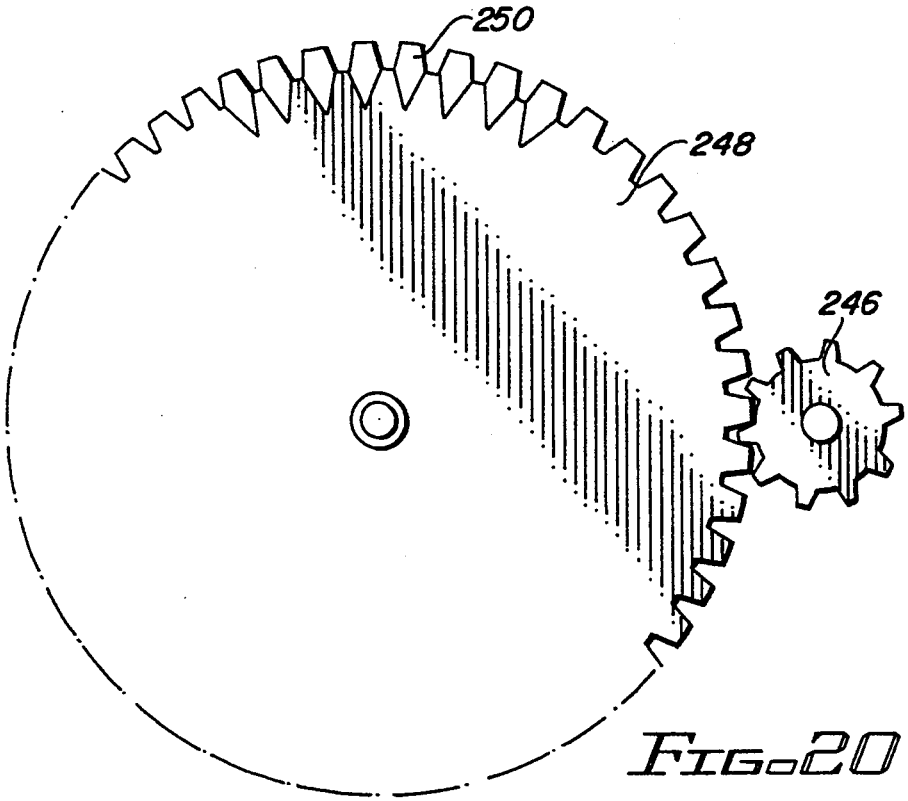
FIG. 20 is a partial front view of the interval drive gear engaging a reducing intermediate gear.
Figure 19:
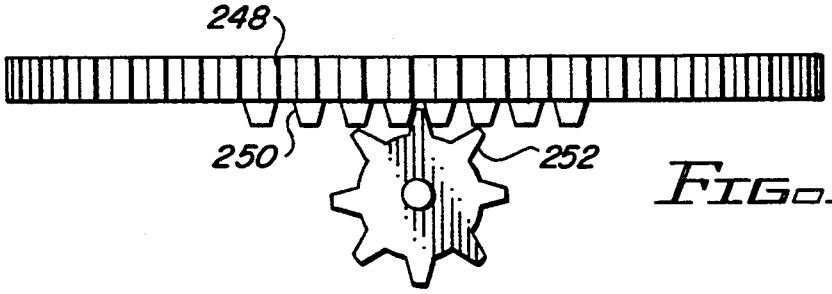
FIG. 19 is a partial top view showing the interval drive teeth of the interval drive gear engaging the translational intermediate gear, the translational intermediate gear engages the coupling gear.
Figure 24:
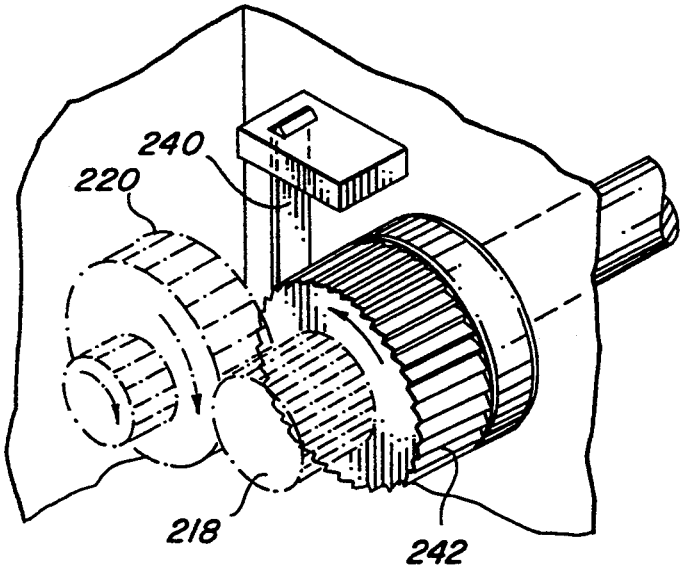
FIG. 24 is a partial perspective view of the ratchet and pawl mechanism used to engage the drum.
Figure 21:
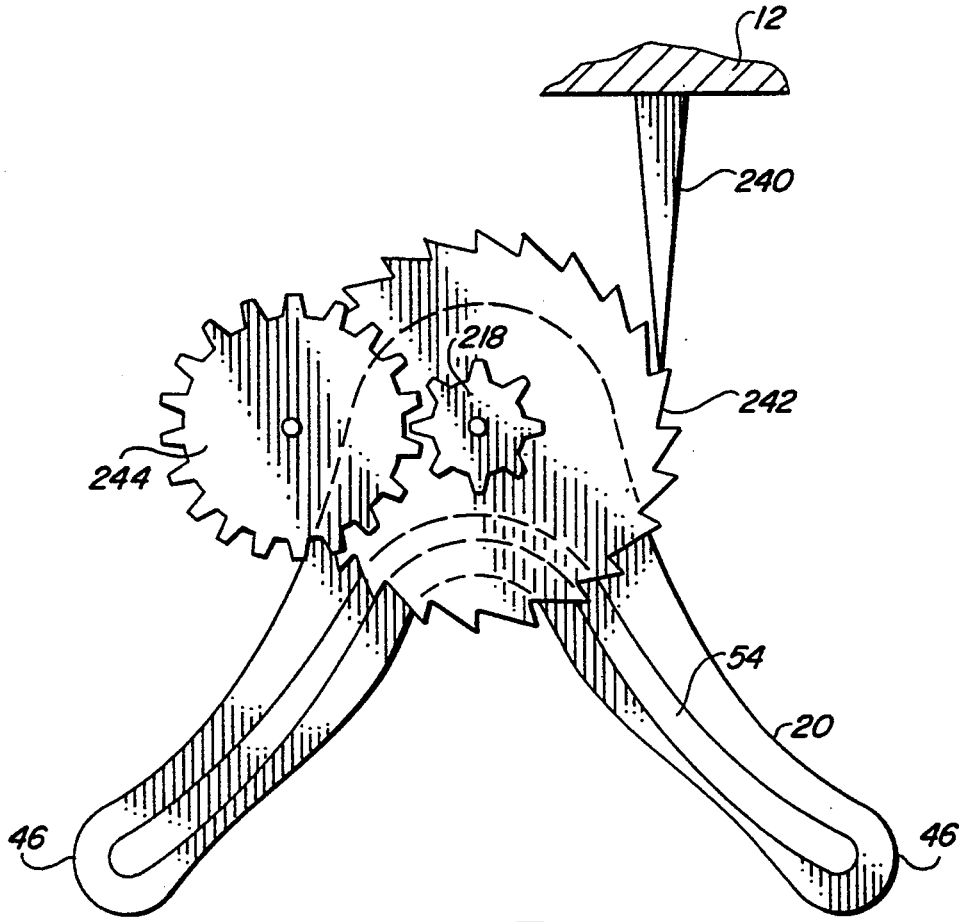
FIG. 21 is a partial-view showing driven gear engaging the reduction gears in relation to the oscillator.
Figure 23:
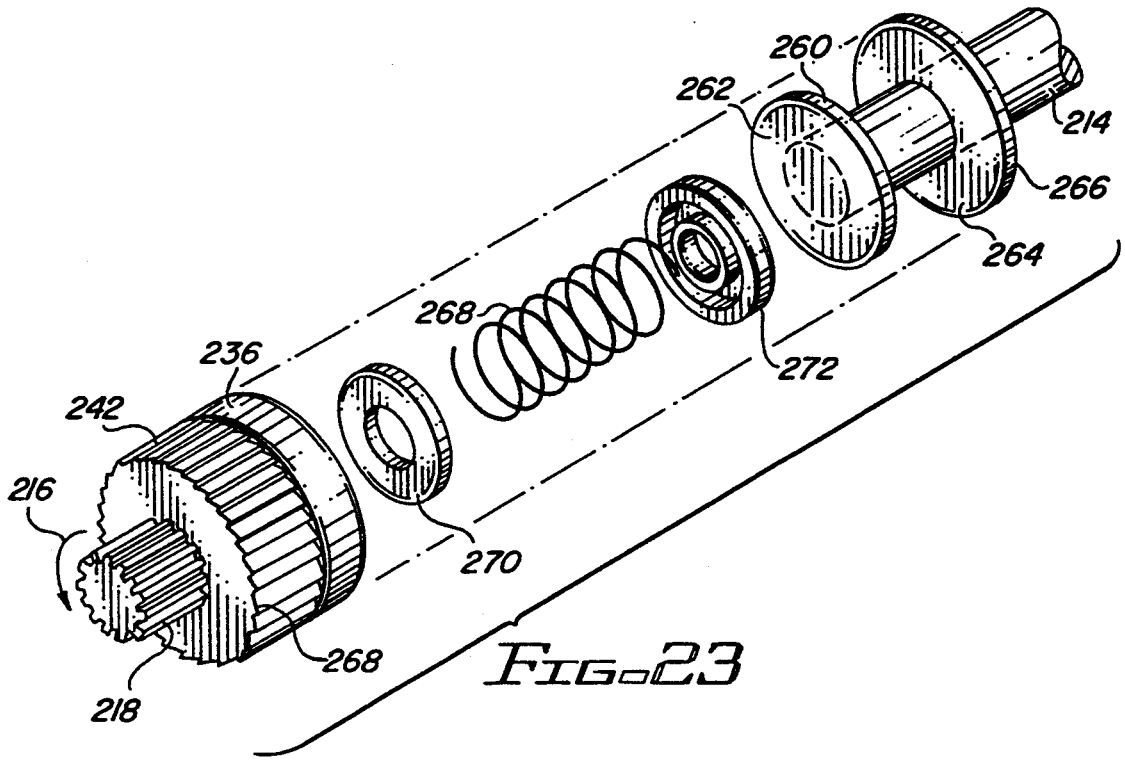
FIG. 23 is a perspective exploded view of the friction gear assembly.

The friction drive illustrated in FIG. 23 through 25 comprises a first friction surface 260 defined by a disc element 262, to which the drive shaft 214 is secured or with which it is integrally formed. The friction disc 262 is urged into contact with a second friction surface 264 defined by a second disc 266, by means of a compression spring 268 and the second friction disc 266 is in turn associated with a driven gear 218. The second friction disc 266 is secured to a drum formation 236 to which the driven gear 218 is secured or with which it is integrally formed so that rotational movement of the friction disc 266 causes rotational movement of the gear 218.

In an alternative arrangement (not shown), the driven gear 218 is secured to a friction disc such as that shown at 262 which is urged into frictional engagement with a friction surface defined by the interior blind face 268 of the drum formation 236, with the drive shaft 214 secured directly to the drum 236 or to the friction disc 262.

In the embodiment illustrated, the friction disc 262 is induced into frictional engagement with the friction surfaces 264 by means of a compression spring 268 which terminates in washers 270 and 272.

In order to limit movement of the driven gear 218 to one directional movement as shown by the arrow 216; a pawl 240 and ratchet 242 arrangement is also provided, with teeth of the ratchet 242 being defined on the outer surface of the drum 236. With reference to FIG. 24, a pawl 240 in the form of a resilient leaf spring 240 is provided to engage the teeth 242 to prevent reverse rotation of the drum 236 and thus the driven shaft 218.

The pressure relief valve 300 is further described as follows:

The housing 12 incorporated a suction chamber 14 comprised of side walls 22 and end walls 28 and 30 defined by the housing itself.

The coupling 26 is provided on the housing 12 for a suction hose (not shown) used to connect the suction head to the filter pump of a swimming pool. Coupling the housing 12 and chamber 14 to the filter pump causes flow into the suction chamber 14 via the mouth 16 and the flow impinges first on one edge 46 and then on the other edge 46 of the oscillator 20 causing the latter to swing to and fro.

It will be appreciated that if large objects such as leaves, twigs and the like, collect in restricted areas of the flowpath past the oscillator 20, the flow path could become starved and if no relief or by-pass valve is provided, the motor driving the pump will be damaged.

Figure 11:
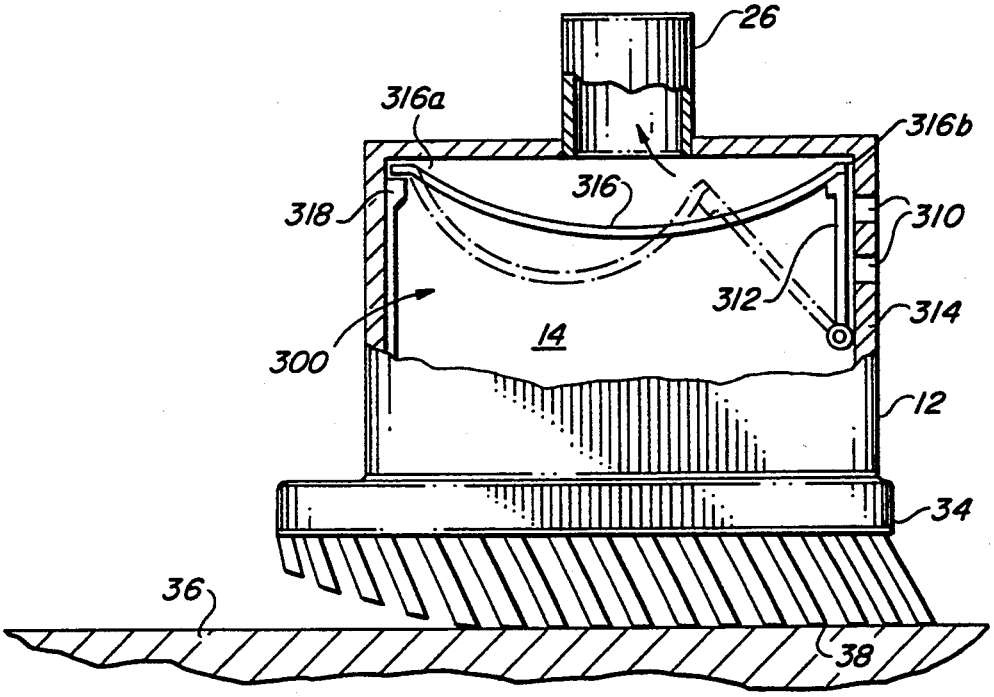
FIG. 11 is a partial cut-away view of the cleaner housing showing one embodiment of a pressure relief valve using leaf springs.

In accordance with the present invention the housing 12 includes by-pass apertures 310 in the suction chamber 14 at the upper end thereof close to coupling 26 for the suction hoses. These by-pass apertures 310 are closed off by a by-pass closure 312 pivotally mounted within suction chamber 14 on hinge pin 314. Leaf springs 316 are secured at their ends **316*a* on to the housing 12 within the suction chamber 14 and at their opposite ends 31*b* to the by-pass closure 312. Thus the leaf springs 31 bias the closure 312 to a position closing the by-pass apertures 310. FIG. 11** describes this embodiment.

With normal operation of the suction cleaner device the restricted passages in the location of the oscillator 20 are unblocked and the springs 316 exert sufficient force to maintain the closure 312 in a closed position. However, should the entrance to the suction chamber become blocked with leaves or other debris, the pressure in the suction chamber 14 will drop abnormally through the action of the filter pump causing the closure 312 to be forced away from the by-pass apertures 310 against the biasing action of springs 316. Water will thus flow into the suction chamber 14 and the suction hose via the by-pass apertures 310 until the blockage of the suction chamber is removed. In this way by-pass apertures 310 act as a pressure relief valve 300 ensuring that the pump is not starved and that its motor is not endangered. It will be appreciated that the positioning of the by-pass apertures 310 downstream from the oscillator but away from the pool system weir render it unlikely that the apertures 310 will become blocked. Furthermore it eliminates air suction at the weir when the water level is low.

In addition, the strength of springs 316 is balanced to ensure that water is drawn in via the by-pass valve in a controlled way providing an additional means for regulating the speed of the oscillator and thus the suction at the suction chamber mouth 16.

Figure 13:
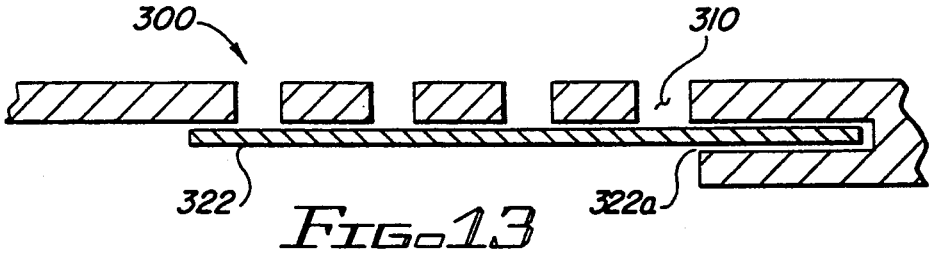
FIG. 13 is a partial cross-sectional view of the pressure relief valve in the preferred embodiment.
Figure 12:
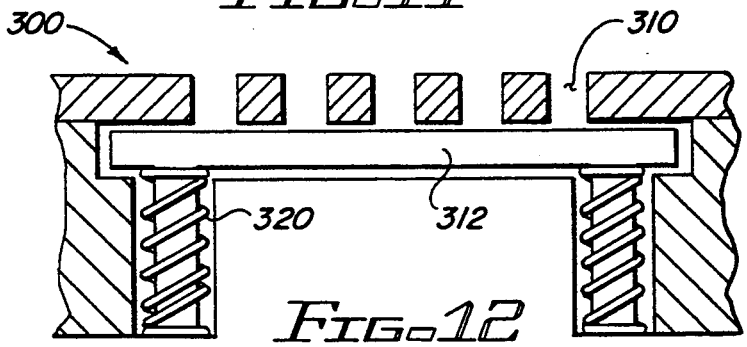
FIG. 12 is a coil spring version of the pressure relief valve in a partial cross-sectional view.
Figure 15:
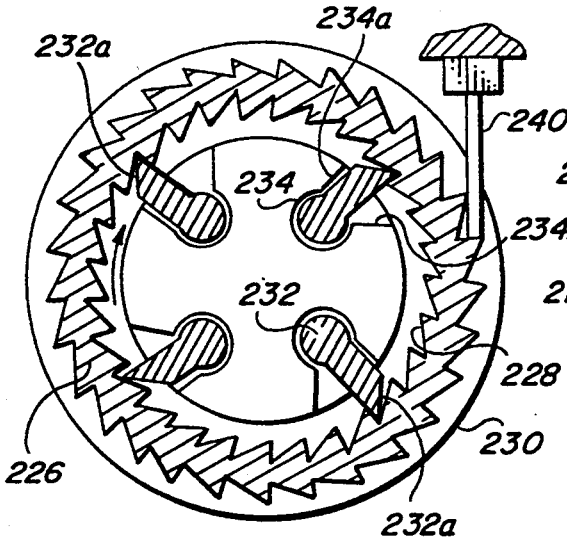
FIG. 15 is a partial cross-sectional view of the drive mechanism, sprags shown in a latched state.
Figure 14:
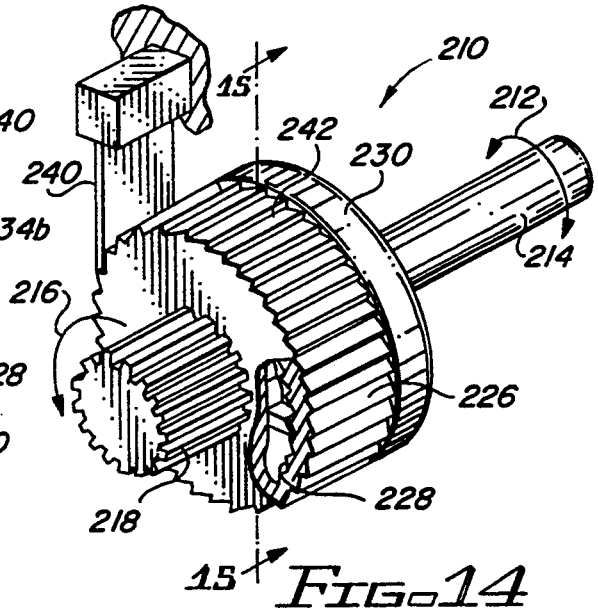
FIG. 14 is a perspective view of the drive mechanism showing the sprag, pawl and ratchet assemblies.
Figure 16:
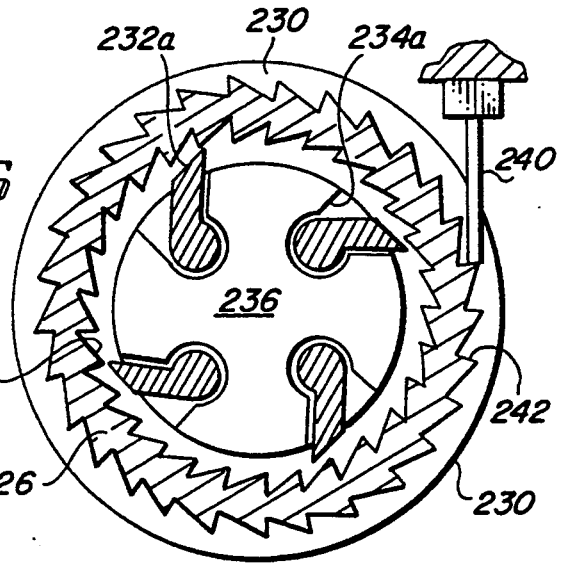
FIG. 16 is a second partial cross-sectional view of the drive mechanism showing the sprags in a freed state.
Figure 17:
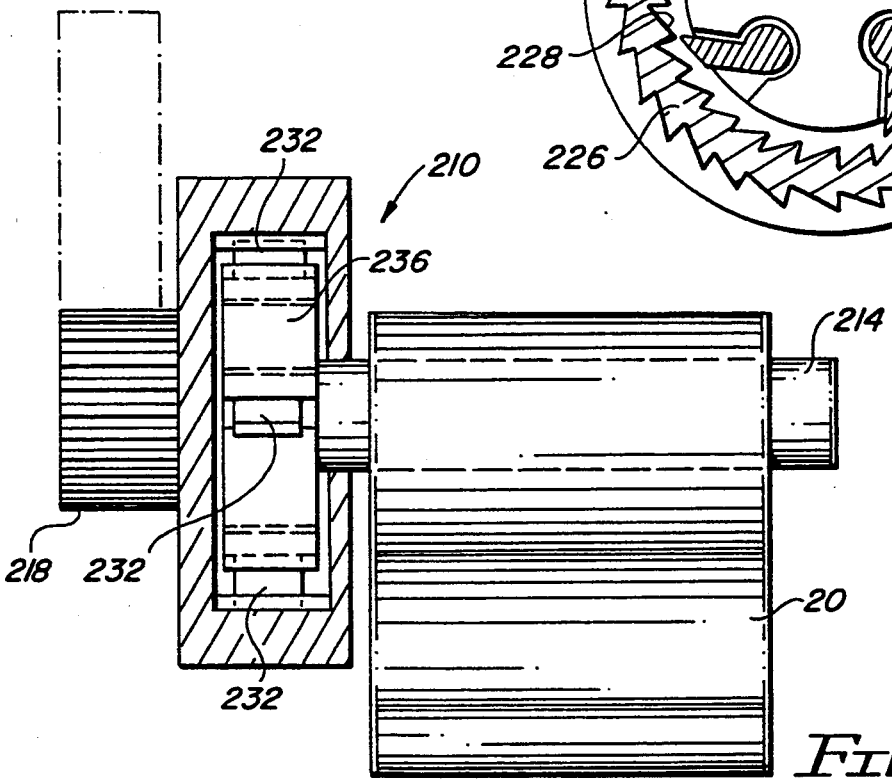
FIG. 17 is a partial cross sectional view of the drive mechanism communicating with the oscillator.
Figure 22:
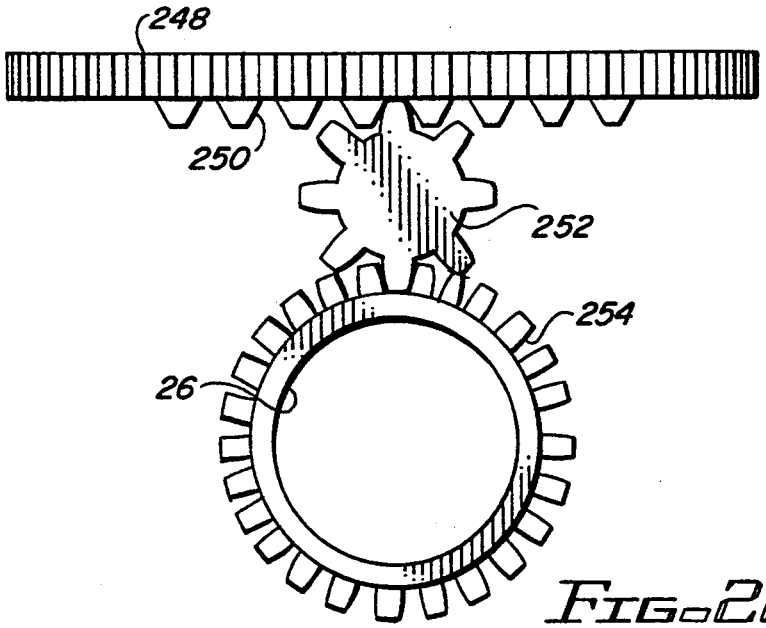
FIG. 22 is a partial top view showing the rotatable coupling, coupling gear being engaged by the interval drive gear through the translational intermediate gear.
Figure 18:
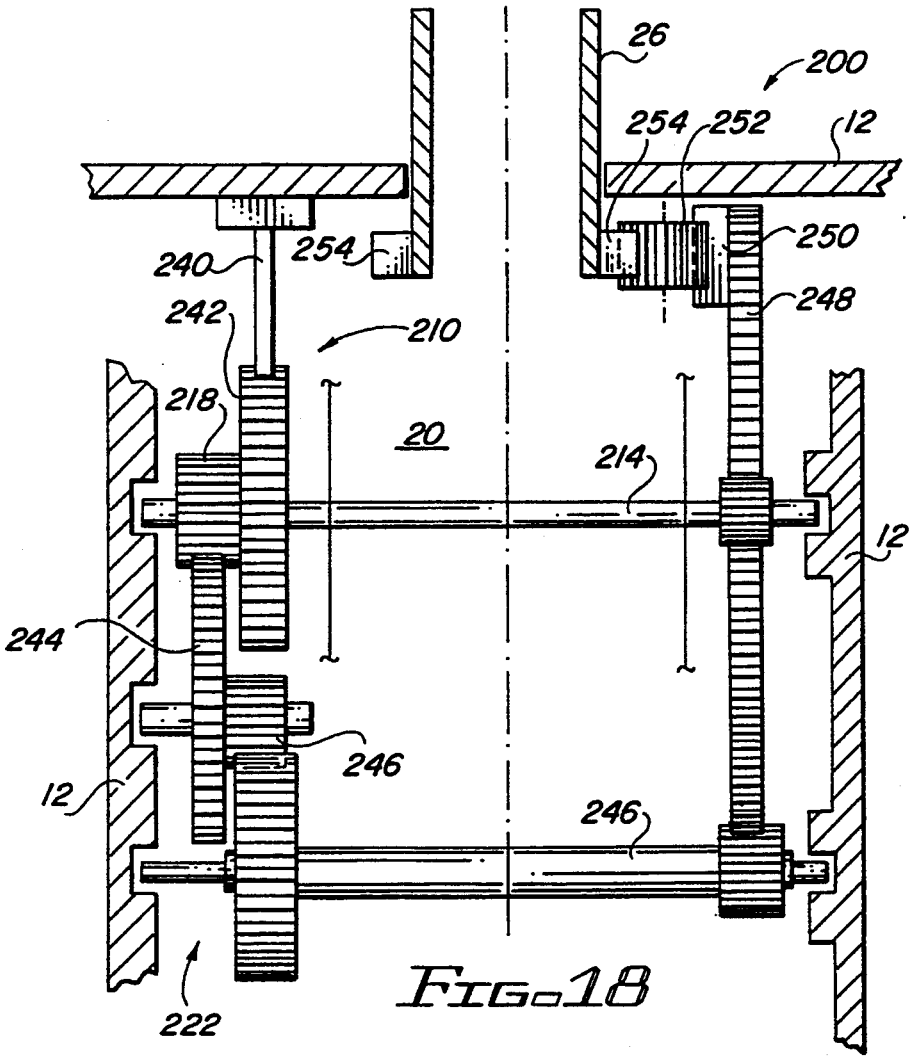
FIG. 18 is a partial cross-sectional view of the gear train and rotatable coupling engagement.

In a similar manner (illustrated in FIG. 12), coil springs 320 can be used to hold the by-pass closure 312 against the by-pass apertures 310. In a third and preferred embodiment, the by-pass apertures 310 are closed using a flexible plate 322 biased against the apertures 310 by affixing one end of the plate **322*a* to the chamber wall adjacent the apertures as described in FIG. 13**.

This concludes the description of the preferred embodiments. A reading by those skilled in the art will bring to mind various changes without departing from the spirit and scope of the invention. It is intended, however, that the invention only be limited by the following appended claims.

What is claimed is:

1. A self-propelled submersible suction cleaner comprising:

a housing having a top, a bottom, a front side and a rear side opposing the front side, a suction chamber within the housing, the chamber having a peripheral wall;

a rotatable coupling at the top of the housing and in fluid communication with the suction chamber, the coupling adapted for connection to a suction source;

an oscillator pivotally mounted within the suction chamber for providing alternating vibratory impacts against the peripheral wall of the chamber along a direction of travel lateral to the front and rear sides responsive to fluid passing across the oscillator;

shoe means responsive to the vibratory impacts to propel the cleaner in a predetermined direction;

a drive shaft fitted in the housing and coupled to the oscillator for movement therewith;

a collar fitted to the drive shaft, the collar having sprag elements extending radially therefrom and freely pivoted thereto;

a ring encircling the collar, the ring having inside teeth engageable by the sprag elements, the sprag elements dimensioned and selected to act in a dense medium which serves to hold the sprag elements stationary relative to the collar upon angular movement thereof causing the sprag elements to move to a first extreme position upon rotation of the shaft in one direction and to a second extreme position upon rotation of the shaft in the reverse direction, thereby engaging the teeth of the ring during such movement;

means for limiting rotation of the ring in one direction;

a drive gear affixed to the ring;

a gear train having a first gear rotatably engaged with the drive gear, reduction gear rotatably engaged with the first gear, a coupling gear affixed to the rotatable coupling; and an intermediate gear rotatably engaging the reduction gear and the coupling gear and having coupling gear engaging teeth spaced at defined intervals so as to generate rotation of the coupling at the defined intervals.

2. A submersible cleaner, comprising:

an elongated housing having a top, a generally planar bottom, a front and a rear opposing the front and a chamber within the housing, the chamber having a peripheral wall defining a chamber opening along the bottom of the housing;

a coupling extending into the housing and in fluid communication with the chamber, the coupling adapted for connection to a differential pressure source capable of forcing a fluid through the chamber;

an oscillator pivotally mounted within the chamber for imparting vibratory motion to the housing responsive to fluid passing across the oscillator;

shoe means fitted across the bottom of the housing and around the chamber opening, the shoe means including plural elongated, laterally spaced tread elements at the front of the housing and plural elongated, laterally spaced tread elements at the rear of the housing, with elongation of each tread element extending generally parallel to the direction of the housing elongation, substantially all of the elongated tread elements extending downwardly from the shoe and angled rearwardly with respect to the bottom of the housing; and wherein the shoe means and the oscillator cooperate together so that the vibratory motion and the downward and rearward extension of the elongated tread elements cooperate together to move the housing along a forwardly direction of travel.

3. The self-propelled submersible suction cleaner as recited in claim 2 wherein the shoe further comprises an external skirt extending at least partially around the periphery of the bottom of the housing, and an internal skirt extending around the peripheral wall of the suction chamber.

4. The cleaner recited in claim 2 wherein the elongated tread elements adjacent the front are substantially shorter than the remaining tread elements, so that the tread elements adjacent the front form a transition region to facilitate transitioning of the cleaner between walls of a body of fluid in which the housing is emersed.

5. The cleaner recited in claim 4 wherein the transition region at the front is rounded.

6. The cleaner recited in claim 4 wherein the rearward angle of some of the tread elements increases progressively in a direction toward the rear of the housing.

7. The cleaner recited in claim 4 wherein the tread elements adjacent the rear are substantially shorter than the tread elements centrally located along the shoe between the rear and the front.

8. The cleaner recited in claim 2 wherein the tread elements are generally parallel with each other along the direction of elongation.

9. The cleaner recited in claim 2 wherein at least a portion of the shoe means is removably fitted about the bottom of the housing.

10. The cleaner recited in claim 2 wherein the shoe means comprises an elongated integral flap along the rear being substantially parallel with the direction of housing elongation.

11. The cleaner recited in claim 10 wherein the flap extends from the rear and inwardly toward the chamber.

12. The cleaner recited in claim 2 wherein the shoe means comprises an integral flap along the front and parallel with the direction of housing elongation.

13. The submersible cleaner of claim 2, further comprising the oscillator including an elongated slot along an edge thereof with a seal slidably mounted in the elongated slot and retractable toward and away from the peripheral chamber wall, and wherein the elongated slot is substantially oversize with respect to the slidable seal mounted therein, and wherein the oscillator includes an opening exposing the seal to fluid flow.

14. The submersible cleaner recited in claim 2, further comprising rubber-like buffer pads fitted within the housing and aligned for receiving alternating vibratory oscillator impacts to protect the chamber and housing from damage resulting from the action of the oscillator.

15. The submersible cleaner recited in claim 2, further comprising means for turning the cleaner about a rotational axis extending through the top of the housing.

16. The cleaner recited in claim 15 wherein the rotational axis is coaxial with the coupling.

17. The submersible cleaner recited in claim 2, further comprising a limiter member extending forwardly beyond the front of the housing, the limiter member being dimensioned and disposed such that when a forward portion of the member breaks the surface of a liquid in which the housing is moving, gravitational force diminishes any forward impetus of the housing, the limiter member including means between the limiter member and the housing for permitting the housing to move independent of the movement of the limiter member during operation of the cleaner.

18. The self-propelled submersible suction cleaner as recited in claim 17 wherein the limiter member comprises as substantially hollow member connected to the housing, the housing having openings communicating with the hollow limiter member so as to permit the liquid filling the housing to also fill the hollow limiter member.

19. The submersible cleaner recited in claim 2, further comprising the oscillator including an elongated slot along an edge thereof with a seal slidably mounted in the elongated slot and retractable toward and away from the peripheral chamber wall, and slide means fixed to and extending laterally away from the seal for facilitating the sliding of the seal back and forth.

20. The submersible cleaner recited in claim 2 comprising the oscillator having a generally bell shape in a cross section lateral to the pivot axis.

21. The cleaner recited in claim 20 wherein the oscillator includes two sides, each side extending from the pivot axis toward the chamber wall, and with a concavity along each side between the pivot axis and the extremity of the side as viewed from above the pivot axis in a direction toward the chamber opening.

* * * * *

UNITED STATES PATENT AND TRADEMARK OFFICE
Certificate

Patent No. 5,404,607 Patented: April 11, 1995

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; Dieter J. Rief, Santa Rosa, CA; and Herman Frentzel, Sausalito, CA.

Signed and Sealed this Thirteenth Day of September 2005.

JILL WARDEN
*Supervisory Patent Examiner*
Art Unit 1743